United States Patent [19]

Williams et al.

[11] 4,033,857

[45] July 5, 1977

[54] FLUIDIZED CATALYTIC CRACKING PROCESS WITH IMPROVED LIGHT CYCLE GAS OIL STRIPPING

[75] Inventors: Dale Williams; James H. Colvert; Frederick C. Jahnke, all of Houston, Tex.

[73] Assignee: Texaco Inc., New York, N.Y.

[22] Filed: Dec. 22, 1975

[21] Appl. No.: 643,050

[52] U.S. Cl. ..... 208/102; 208/103; 208/164; 208/354; 208/365

[51] Int. Cl.[2] ..... C10G 7/00; C10G 37/00

[58] Field of Search ..... 208/100, 102, 103, 164, 208/354, 355, 365

[56] References Cited

UNITED STATES PATENTS

| | | | |
|---|---|---|---|
| 2,321,826 | 6/1943 | Kraft et al. | 208/355 |
| 2,327,534 | 8/1943 | Lambert | 208/355 |
| 2,879,224 | 3/1959 | Lawson | 208/100 |
| 2,890,164 | 6/1959 | Woertz | 208/164 |
| 3,751,359 | 8/1973 | Bunn | 208/164 |

*Primary Examiner*—Herbert Levine
*Attorney, Agent, or Firm*—Carl G. Ries; Thomas H. Whaley; Douglas H. May, Jr.

[57] ABSTRACT

The present application discloses a fluidized catalytic cracking process wherein light cycle gas oil is stripped of heavy naphtha components employing reboiled light cycle gas oil as stripping vapor. Heavy naphtha vapors stripped from the light cycle gas oil are returned to the reaction vapor as primary stripping vapor. This process results in increased naphtha octanes, and reduced sour water production from a fluidized catalytic cracking unit.

3 Claims, 1 Drawing Figure

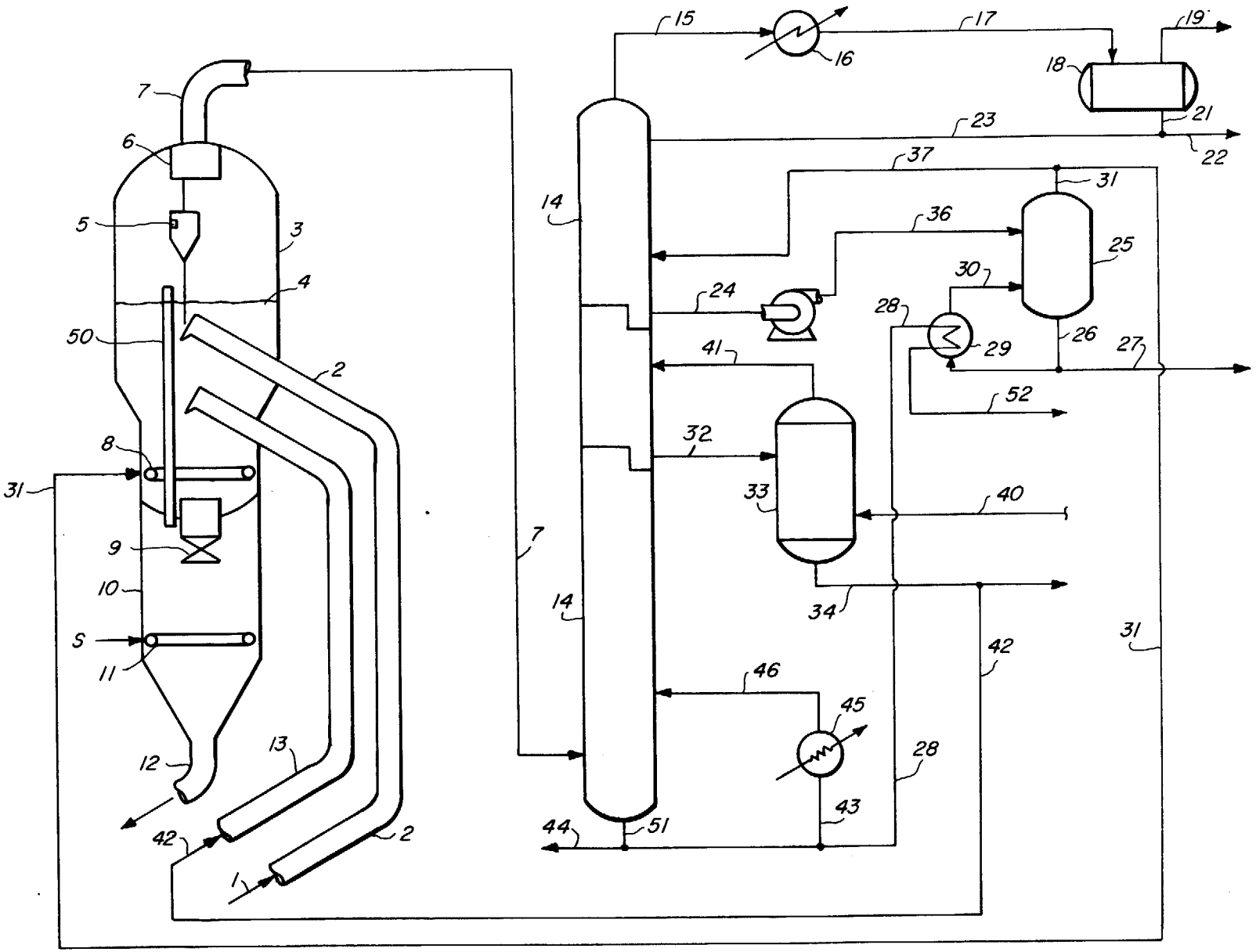
19
21
22
18
17
23
16
15
31
25
27
26
52
29
30
28
36
37
24
41
32
33
34
40
42
45
43
46
51
44
14
7
2
3
4
13
1
6
5
50
8
9
10
11
12
S

FLUIDIZED CATALYTIC CRACKING PROCESS WITH IMPROVED LIGHT CYCLE GAS OIL STRIPPING

BACKGROUND OF THE INVENTION

The present invention relates to a fluidized catalytic cracking process wherein fresh hydrocarbon charge is converted into lower boiling cracked hydrocarbons, in a reaction zone, wherein cracked hydrocarbon vapors from the reaction zone are separated, in a fractionation zone, into desired fractions including a gas fraction, a naphtha fraction, a light cycle gas oil fraction, an intermediate cycle gas oil fraction and a heavy cycle gas oil fraction. More particularly, the present invention relates to an improved process for obtaining a light cycle gas oil fraction from said product fractionation zone, stripping heavy naphtha components from said intermediate cycle gas oil fraction and recycling said heavy naphtha components to the reaction zone at an elevated temperature for conversion into light naphtha components having an increased octane value.

Commonly in commercial processes for fluidized catalytic cracking of hydrocarbons, a fresh hydrocarbon charge stock is contacted with hot regenerated catalyst in a reaction zone for conversion of said charge stock into lower boiling cracked hydrocarbons and coke. Subsequently, cracked hydrocarbon vapors and spent catalyst are separated, in a reaction vessel, forming a dense phase fluidized bed of spent cracking catalyst and a dilute phase comprising a minor amount of catalyst suspended in said cracked hydrocarbon vapors, the dense phase fluidized catalyst bed has unvaporized hydrocarbons occluded therein. A substantial proportion of these unvaporized hydrocarbons may be volatilized by contacting the dense phase fluidized catalyst bed with a stripping vapor. Commonly, a vapor, such as steam, is introduced into the lower portion of the reaction vessel for maintaining the dense phase catalyst bed in a fluidized state, and for stripping a portion of the occluded hydrocarbons from the spent catalyst. Vapors other than steam may be used for this purpose, for example, the cracked hydrocarbon vapors entering the reactor vessel; flue gas; etc. Unvaporized hydrocarbons remaining upon the spent catalyst is referred to as "coke". From the reactor vessel dense phase fluidized catalyst bed, spent catalyst is transferred from the reaction zone to a regeneration zone for burning coke and regenerating said catalyst.

Cracked hydrocarbon vapors from the reaction zone are transferred into a product fractionation zone wherein the cracked hydrocarbon vapors are separated into desired product fractions. Such product fractions may include a gas fraction, a naphtha fraction, a light cycle gas oil fraction, an intermediate gas oil fraction, and a heavy cycle gas oil fraction. The gas fraction comprises low molecular weight hydrocarbons and hydrogen. The naphtha fraction comprises hydrocarbons boiling in the range of about $C_4$-430° F which are useful in the manufacture of gasoline motor fuels. The light cycle gas oil fraction, having a boiling range of about 400°–650° F, is useful in the manufacture of fuel oils. The intermediate cycle gas oil is a distillate fraction boiling in the range of about 540°–750° F, and although this intermediate cycle gas oil fraction may be used for production of heavy fuel oil, it is common practice for a substantial portion to be recycled to the reaction zone for conversion into additonal lower boiling hydrocarbons. The heavy cycle gas oil fraction comprises a nondistillate bottoms fraction from the fractionation zone.

For economical operation of a fluidized catalytic cracking unit within a petroleum refinery it is desirable to have the ability to adjust the ratio of the various product fractions, according to product demand. For example, in the Winter season the demand for fuel oil increases and it is desirable to include within the light cycle gas oil fraction the maximum amount of hydrocarbons boiling within the fuel oil range. In Summer, demand for gasoline increases and it is desirable to include within the naphtha fraction the maximum amount of gasoline boiling range hydrocarbons. For obtaining flexibility in product distribution, it is common practice to provide steam strippers for adjusting the initial boiling points of the light cycle gas-oil fraction and the intermediate cycle gas oil fraction. Light cycle gas oil from the fractionation zone is charged to the light cycle gas oil stripper and stripping steam is passed therethrough in order to vaporize naphtha boiling range components from the light cycle gas oil fraction. By adjusting the amount of stripping steam employed, more or less of the naphtha hydrocarbons may be vaporized and returned to the fractionation zone for recovery with the naphtha fraction. That is, by controlling the steam stripping of light cycle gas-oil, the ratio of naphtha to light cycle gas oil may be adjusted over a limited range. The naphtha boiling range components stripped from the light cycle gas fraction boil generally in the range of about 400°–430° F, and have a lower octane value than lower boiling naphtha recovered from the product fractionation zone.

Also, it is common practice to provide a steam stripper for the intermediate cycle gas oil fraction such that light cycle gas-oil boiling range components of this fraction may be vaporized and returned to the product fractionation zone for recovery with the light cycle gas-oil fraction. Thus, a portion of light cycle gas-oil boiling range hydrocarbons present in the intermediate cycle gas oil fraction may selectively be recovered as light cycle gas-oil product, or may be included with the intermediate cycle gas-oil for recycle to the reaction zone or use as heavy fuel oil.

One disadvantage of such steam stripping for the adjustment of the initial boiling points of the light cycle gas oil fraction and the intermediate cycle gas oil fraction is, substantial quantities of steam, in the range of about 1 to 10 pounds of steam per barrel of hydrocarbon, are required. This steam passes overhead from the product fractionation zone and is condensed, forming a foul water component containing such impurities as hydrogen sulfide, cyanides, phenols, etc., which must be subjected to substantial treating prior to disposal.

SUMMARY OF THE INVENTION

According to the method of the present invention, improvements are disclosed for a process of fluidized catalytic cracking of petroleum hydrocarbons into lower boiling cracked hydrocarbon products. In such process, fresh hydrocarbon charge stock is contacted with hot regenerated catalyst in a transport reaction zone for conversion into lower-boiling hydrocarbons.

Catalyst and cracked hydrocarbon vapors flow from the transport reaction zone into a reaction vessel for separation into a dense phase fluidized catalyst bed and a dilute phase comprising cracked hydrocarbon vapors. Cracked hydrocarbon vapors, recovered substantially free of entrained catalyst from the reaction vessel are separated, in a product fractionation zone into various product fractions including a gas fraction, a naphtha fraction, a light-cycle gas oil fraction, an intermediate cycle gas oil fraction, and a heavy cycle gas oil non-distillate fraction. Said light cycle gas oil fraction is stripped, in a light cycle gas oil stripping zone, for separation of heavy naphtha boiling range components therefrom and for production of a stripped light cycle gas oil product stream boiling in the range of about 400°-650° F which is useful in fuel oil products. Said intermediate cycle gas-oil fraction is stripped, in an intermediate cycle gas oil stripping zone, for removal of light cycle gas oil boiling range components therefrom and for production of a stripped intermediate cycle gas oil product boiling in the range of about 575°-750° F. At least a portion of said stripped intermediate cycle gas oil is recycled to said reaction zone for conversion, in the presence of regenerated catalyst, into additional lower boiling cracked hydrocarbon products. Accordingly, the improvements of the present invention to such fluidized catalytic cracking process comprises:

a. stripping said light cycle gas oil fraction within said light cycle gas oil stripping zone with reboiled light cycle gas oil vapors for production of an overhead vapor steam comprising heavy naphtha hydrocarbons and a bottom steam comprising stripped light cycle gas oil;

b. reboiling a portion of said stripped light cycle gas oil by indirect heat exchange with heavy cycle gas oil, for vaporizing a portion of said stripped light cycle gas oil;

c. returning the reboiled light cycle gas oil of step (b) to said light cycle gas oil stripping zone as stripping vapor employed in step (a); and d. charging the light cycle gas oil stripping zone overhead vapors to the lower portion of said reaction vessel for fluidizing said dense phase catalyst bed, and stripping volatile hydrocarbons from spent catalyst in said dense phase bed.

Advantages of the process improvements of the present invention over processes of the prior art include a substantial reduction in preheat for fresh hydrocarbon charge to said fluidized catalytic cracking section; elimination of stripping steam which produces foul water, from the light cycle gas oil stripper; utilizing substantial heat energy from available from said heavy cycle gas oil in the light cycle gas-oil stripper; elimination or reduction of steam used as fluidization vapor in the reaction vessel; and increased octance of naphtha product from the fluidized catalytic cracking process resulting from cracking the heavy naphtha recycled from the light cycle gas oil stripper to the reaction vessel into lower boiling, higher octane naphtha.

BRIEF DESCRIPTION OF THE DRAWING

The drawing is a schematic representation of a fluidized catalytic cracking process employing the process improvements of the present invention.

DETAILED DESCRIPTION OF THE DRAWING

The appended drawing is a schematic representation of a fluidized catalytic cracking process employing the process improvements of the present invention. In the drawing, auxiliary piping, pumps, instrumentation valves, etc. which are normally employed in such a process, but which are unnecessary for an understanding of the present invention, have been omitted. The fluidized catalytic cracking process in the drawing embodies the improvements of the present invention and is intended for purposes of demonstration only. It is not intended that the process of the drawing serve as a limitation to the present invention, which is fully set out in the claims appended to this specification.

In the drawing, fresh feed hydrocarbon charge stock in line 1, is contacted in riser 2 with hot regenerated catalyst for cracking into lower boiling hydrocarbons. Cracked hydrocarbon vapors and spent catalyst exits the upper end of riser 2 into reaction vessel 3 wherein said cracked hydrocarbon vapors disengaged said spent cracking catalyst, forming a hydrocarbon vapor phase and a dense, fluidized bed of spent cracking catalyst, having an upper surface 4, within said reaction vessel 3. Volatile hydrocarbons are stripped from said spent cracking catalyst and said dense phase catalyst bed is maintained in a fluidized condition by the flow of heavy naphtha stripping vapors from stripping vapor ring 8, as will be further described herein. Said heavy naphtha flows upwardly through said dense phase fluidized spent catalyst bed. The heavy naphtha stripping vapors, in the dense phase fluidized catalyst bed, are cracked into lower boiling naphtha hydrocarbons, having a substantial higher octane value than said heavy naphtha vapors. Additionally, said heavy naphtha stripping vapors strip volatile hydrocarbons from the spent catalyst in the dense phase fluidized bed. The cracked naphtha and volatilized hydrocarbons disengage dense phase fluidized bed upper surface 4 for entry into the hydrocarbon vapor dilute phase in the upper portion of reaction vessel 3.

In the drawing, spent catalyst from the bottom of reaction vessel 3 passes through slide valve 9 into stripping section 10 wherein additional volatile hydrocarbons are stripped therefrom by the action of stripping vapors from stripping vapor ring 11. Stripping vapors and hydrocarbon vapor pass from the upper portion of stripping section 10 to the hydrocarbon vapor phase in reaction vessel 3 via stripper vent line 50. Stripped catalyst passes via line 12 to a regeneration section, not shown, wherein said catalyst is regenerated for contact with additional hydrocarbon charge.

In the drawing, hydrocarbon vapors in the upper portion of said reaction vessel 3 pass through cyclone separator 5, for removal of entrained catalyst, into plenum chamber 6. It is to be understood that said cyclone separator 5 may comprise a plurality of cyclone separators in parallel and series arrangement designed for substantially complete separation of catalyst from said hydrocarbon vapors. From plenum chamber 6, cracked hydrocarbon vapors pass via line 7 into the lower portion of product fractionation column 14 wherein said hydrocarbon vapors are fractionated into a plurality of fractions. From the top of product fractionator 15 a vapor fraction is withdrawn via line 15 for condensation in condenser 16. Fronm condenser 16, condensate and wet gas passed via line 17 into overhead receiver 18 wherein said condensate separates from said wet gas. From overhead receiver 18 the wet gas, comprising $C_4$ and lighter components, is withdrawn via line 19 for further treatment in a gas separation plant, not shown. Liquid condensate, comprising naphtha hydrocarbons, boiling in the range of $C_5$-430° F., are withdrawn from overhead receiver 18 via line 21. A portion of said condensate is yielded via line 22, as naphtha product from the fluidized catalytic cracking process. A second portion of said liquid condensate from line 21 passes via line 23 to the upper portion of said product fractionation column 14 as external reflux for maintaining the end boiling point of said naphtha product fraction in the range of about 400°–430° F.

In the drawing, a liquid light cycle gas oil fraction containing naphtha boiling range hydrocarbons is withdrawn from said fractionation column 14 via line 24. Said light cycle gas oil fraction has an initial boiling point in the range of about 400°–430° F, and an end point of about 650° F. From line 24 the light cycle gas-oil fraction is pumped, by pump 35, through line 36 into the upper portion of light cycle gas oil stripping vessel 25 where the said light cycle gas oil fraction is contacted with reboiled light cycle gas oil vapors, thereby stripping heavy naphtha boiling range components from said light cycle gas oil fraction. From the bottom of said light cycle gas oil stripping vessel 25 a stripped light cycle gas oil stream having an initial boiling point in the range of about 420°–450° F is withdrawn via line 26. A portion of said stripped light cycle gas oil is withdrawn as light cycle gas oil product via line 27. A second portion of said stripped light cycle gas oil passes via line 26 into reboiler 29. In reboiler 29 said light cycle gas oil stream is reboiled at a temperature in the range of about 425° to 575° F, by indirect heat exchange with heavy cycle gas-oil having a temperature of about 550° to 700° F., as well be further described. From light cycle gas oil reboiler 29, reboiled light cycle gas oil passes via line 30 into the lower portion of said light cycle gas oil stripping vessel 25, wherein the reboiled light cycle gas oil vapors contact said light cycle gas oil fraction for stripping heavy naphtha components from said light cycle gas oil fraction, as hereinabove described. In stripping vessel 25, the liquid volume ratio of reboiled light cycle gas oil vapor to the light cycle gas oil fraction is fed to the stripping vessel 25 in the range of from about 1/10 to about 8/10. Stripped vapors comprising heavy naphtha boiling range hydrocarbons pass, via line 31, from said light cycle gas oil stripping vessel 25 to stripping vapor ring 8, as hereinbefore described. Alternatively, all or a portion of said heavy naphtha vapors may be returned to fractionation column 14 via line 37.

In the drawing, at an intermediate point of said product fractionation column 14, lower than said light cycle gas oil fraction draw point, an intermediate cycle gas oil fraction boiling in the range of about 575°–750°F. is withdrawn via line 32. Said intermediate cycle gas oil fraction contains substantial light cycle gas oil boiling range components. From line 32 said intermediate cycle gas oil fraction passes into the upper portion of intermediate cycle gas oil stripping vessel 33 wherein light cycle gas oil components are stripped from said intermediate cycle gas oil fraction by contact with stripping vapors from lline 40. From the bottom of said intermediate cycle gas oil stripping vessel 33, a stripped intermediate cycle gas oil stream is withdrawn via line 34. From the top of said intermediate cycle gas oil stripppping vessel 33, hydrocarbon vapors, comprising light cycle gas oil range components flow via line 41 to said product fractionation column 14.

In the drawing, from line 34, a portion of the stripped intermediate cycle gas oil stream is withdrawn into line 42 at a temperature as an intermediate cycle gas oil recycle stream. From line 42 said intermediate cycle gas oil recycle passes into riser 13 wherein said intermediate cycle gas oil recycle is contacted with hot regenerated catalyst for conversion into additional cracked hydrocarbon products. From riser 13 spent catalyst and cracked hydrocarbon vapors exit the top of riser 13 into said fluidized catalytic cracking reaction vessel 3 below the upper surface of said fluidized dense phase catalyst bed. In fluidized catalytic cracking reaction vessel 3 cracked intermediate cycle gas oil vapors disengage the upper surface 4 of the spent catalyst bed and comingle with fresh feed cracked hydrocarbon vapors in the upper portion of reaction vessel 3.

In the drawing, from the bottom of said product fractionation column 14, a non-distillate heavy cycle gas oil stream is withdrawn via line 51 at a temperature in the range of about 600° to 700° F. A portion of said heavy cycle gas oil passes from line 51 via line 51 via line 43 into waste heat boiler 45 wherein said first portion of heavy cycle gas oil is cooled to a temperature in the range of about 400° to 550° F. From waste heat boiler 45, the cooled heavy cycle gas oil flows via line 46 as additional external reflux to the lower portion of said product fraction column 14. As desired, a second portion of said heavy cycle gas oil may be withdrawn from line 51 via line 44 as product heavy cycle gas-oil. A third portion of the heavy cycle gas oil from line 51, flows to reboiler 29 for indirect heat exchange with light cycle gas oil reboiler 29 heavy cycle gas oil flows via line 52 as heavy cycle gas oil product from the fluidized catalytic cracking process.

In the process of the present invention fresh hydrocarbon charge stock and stripped intermediate cycle gas oil are contacted with hot, regenerated fluidized catalytic cracking catalyst under condition of temperature and pressure to effect substantial conversion of charge and recycle into hydrocarbons lower boiling than 430° F., and coke.

Fresh hydrocarbon charge stocks which may used in the process of the present invention include, atmospheric gas-oils, vacuum gas-oils, atmospheric residuums, shale oils, naphthas, and other petroleum and hydrocarbon fractions boiling in the range of about 430° F to about 1100° F. The stripped intermediate cycle gas-oil comprises a fraction recovered in the fractionation zone 14 from the cracked hydrocarbon vapors, and has a boiling range of about 575°–750° F.

Catalysts with which the hydrocarbon charge and intermediate cycle gas-oil may be contacted include fluidized catalytic cracking catalyst. Such catalysts may comprise silica-alumina, silica-magnesia, silica-zirconia, and particularly useful are catalysts comprising an amorphous silica-alumina matrix containing crystalline silica-alumina zeolite, wherein said zeolite is ion exchanged with rare earth, magnesium, and/or hydrogen such that the sodium content is less than about one weight percent of said zeolite. Such fluidized catalytic cracking catalysts are well known in the art.

Reaction temperatures within reaction vessel 3 may be in the range of from about 850° F to about 1100° F, and pressures may be in the range of from about 10 psig to about 50 psig for effecting an overall conversion of fresh hydrocarbon charge and intermediate cycle gas oil of from about 50% to about 90% based upon fresh hydrocarbon charge. Preferably overall conversion, based upon fresh hydrocarbon charge, may range from about 30% to about 75%. Such conversion being defined as (gas oil product) 100%, where gas oil product is that material yielded from the process which has a true boiling point greater than 430° F.

Fractionation column 14, within contemplation of the present invention, is a charge-reboiled column operating an an overhead pressure of from about atmospheric to about 45 psig, wherein the cracked hydrocarbon vapor charge to the column, in line 7, is at a temperature of from about 800° F to about 1100° F. To obtain product fractions of desired boiling range from fractionation column 14, the overhead temperature is maintained at about 175° to 350° F; the light cycle gas-oil draw temperature is in the range of about 400° to 550°F; the intermediate cycle gas-oil draw temperature is in the range of from about 450° to about 625°F.

In light cycle gas oil stripping vessel 25, the light cycle gas-oil fraction is contacted with reboiled light cycle gas oil vapors for stripping heavy naphtha boiling range hydrocarbons and for producing a stripped light cycle gas oil. The light cycle gas-oil fraction from fractionation column 14 has an initial boiling point of from about 225° to 430° F and an end point of about 650° F and contains from about 175° to 430° F heavy naphtha boiling range hydrocarbons. The light cycle gas oil fraction enters the upper portion of stripping vessel 25 at a temperature in the range of about 400° to 550° F, wherein it is contacted with reboiled light cycle gas-oil at a temperature of from about 425° to 550° F. Stripped light cycle gas oil, from the bottom of stripping vessel 25, has an initial boiling point in the range of from about 420°–450° F. By adjusting the temperature of the reboiled light cycle gas oil to light cycle gas-oil fraction in stripping vessel 25, the amount of heavy naphtha boiling range hydrocarbons stripped from the light cycle gas-oil fraction may be controlled. The reboiled light cycle gas-oil has a temperature of from about 425° to 575° F, and comprises about 10 to 50 wt.% vapor. By stripping more or less of the naphtha boiling range hydrocarbons from the light cycle gas-oil fraction the amount of stripped light cycle gas-oil product may be decreased or increased. Light cycle gas oil stripping vessel 25 is operated at a pressure in the range of about 20 to 65 psig, such that heavy naphtha vapors recovered therefrom may be returned as primary stripping vapor to reaction vessel 3.

Heavy naphtha vapors recovered overhead from stripping vessel 25, boil in the range of about 400°–450° F, and have a rather low octane value, in the range of about 80 to 92 research clear octane. Such heavy naphtha vapors, when employed as primary stripping vapors in the lower portion of reaction vessel 3, contact the dense phase fluidized catalyst bed at cracking conditions. Under conditions in the dense phase bed, including temperatures of 800°–1100° F, a substantial portion of the heavy naphtha vapors are cracked into lower boiling light naphtha hydrocarbon, boiling in the range of $C_4$-400° F, and having octane values of about 85 to 96 research clear octane. Thus, in addition to adjusting the initial boiling point of the light cycle gas oil product to a desired value, and to providing primary stripping vapors to the dense phase catalyst bed, the process of the present invention also produces additional quantities of light naphtha products having increased octane value.

It will be obvious to those skilled in the art that many modifications may be made within the scope of the present invention without departing from the spirit hereof, and the invention includes all such modifications.

We claim:

1. In a fluidized catalytic cracking process wherein a fresh feed hydrocarbon is contacted with regenerated catlayst in a cracking zone under cracking conditions, wherein cracked hydrocarbon vapors and spent catalyst from the cracking zone are separated in a reaction vessel to form a dense phase fluidized catalyst bed and a hydrocarbon vapor dilute phase, wherein hydrocarbon vapors from said recation vessel are fractionated, in a product fractionation column into a plurality of fractions including a light cycle gas oil fraction boiling in the range of from about 400° F to about 650° F, wherein said light cycle gas oil fraction is contacted with stripping vapors in a light cycle gas oil stripping vessel forming a vapor phase comprising heavy naphtha components and liquid stripped light cycle gas oil; the improvement which comprises:

a. recovering, from the bottom of said product fractionation column, a non-distillate heavy cycle gas oil fraction, at a temperature of about 600°–700° F;

b. charging said light cycle gas oil fraction from said product fractionation column to said light gas oil stripping vessel at a temperature in the range of about 400°–550° F;

c. reboiling, in a light cycle gas-oil reboiler, a first portion of said stripped light cycle gas oil, in an amount equivalent to about 1/10 to about 8/10 the weight of light cycle gas oil fraction charged to said stripping vessel, by indirect heat exchange with said non-distillate heavy cycle gas oil fraction for producing stripping vapors;

d. charging said reboiled light cycle gas oil to the lower portion of said light cycle gas oil stripping vessel for stripping heavy naphtha components from said light cycle gas oil fraction and e. recovering from said light cycle gas oil stripping vessel a heavy naphtha vapor stream and stripped light cycle gas oil stream.

2. The method of claim 1 wherein said heavy naphtha stream from said light cycle gas oil stripping vessel is charged to the lower portion of said reaction vessel for fluidizing said dense phase catalyst bed, stripping volatile hydrocarbons from catalyst in said dense phase catalyst bed, and for conversion of said heavy naphtha into lower boiling, higher octane light naphtha.

3. In a fluidized catalytic cracking process wherein a fresh feed hydrocarbon is contacted with regenerated catalyst in a cracking zone under cracking conditions including temperatures of about 850°–1100° F, wherein cracked hydrocarbon vapors and spent catalyst from the cracking zone are separated in a reaction vessel to form a dense phase fluidized catalyst bed and a hydrocarbon vapor dilute phase, wherein hydrocarbon vapors from said reaction vessel are fractionated, in a product fractionation column, into product fractions including a light cycle gas oil fraction having an initial boiling point in the range of about 400°–430° F and an end point of about 650° F, and a non-distillate heavy cycle gas oil fraction; the improvement which comprises:

a. stripping said light cycle gas oil fraction in a light cycle gas oil stripping vessel, with reboiled light cycle gas oil vapors for production of an overhead vapor stream comprising heavy naphtha hydrocarbons and a bottom stream comprising stripped light cycle gas oil;

b. reboiling a portion of said stripped light cycle gas oil by indirect heat exchange in a light cycle gas oil reboiler;

c. returning the reboiled light cycle gas oil of step (b) to said light cycle gas oil stripping vessel to provide stripping vapors employed in step (a); and d. charging heavy naphtha vapors from said stripping vessel to lower portion of said reaction vessel for fludizing said dense phase catalyst bed, and for stripping volatile hydrocarbons from said spent catalyst.

* * * * *